US007341006B2

(12) United States Patent
Hernandez

(10) Patent No.: US 7,341,006 B2
(45) Date of Patent: Mar. 11, 2008

(54) FOLDING TABLE ASSEMBLY

(75) Inventor: Hector Ray Hernandez, Fullerton, CA (US)

(73) Assignee: Alltrade Tools LLC, Long Beach, CA (US)

( * ) Notice: Subject to any disclaimer, the term of this patent is extended or adjusted under 35 U.S.C. 154(b) by 171 days.

(21) Appl. No.: 11/263,596

(22) Filed: Oct. 31, 2005

(65) Prior Publication Data

US 2007/0095257 A1 May 3, 2007

(51) Int. Cl.
*A47B 3/00* (2006.01)

(52) U.S. Cl. ..... 108/115; 108/133

(58) Field of Classification Search ..... 248/127, 248/128, 129, 121, 125.1, 122.1, 125.5, 130, 248/188.1, 188.6; 108/115, 116, 133, 125, 108/129, 131, 132
See application file for complete search history.

(56) References Cited

U.S. PATENT DOCUMENTS 262,176 A 8/1882 Cobb
1,938,507 A * 12/1933 Wilson ..... 403/93
1,979,568 A * 11/1934 Bales et al. ..... 108/125
2,271,332 A * 1/1942 Ellington ..... 403/65
2,664,329 A * 12/1953 Kraska ..... 108/133
2,690,942 A * 10/1954 Marcus ..... 108/18
2,973,803 A 3/1961 Mickelson
2,984,859 A * 5/1961 Steiner ..... 16/291
3,396,928 A * 8/1968 Lay ..... 248/188.6
3,669,392 A * 6/1972 Saunders ..... 248/121
3,726,393 A 4/1973 Thompson
3,788,587 A 1/1974 Stemmier
3,897,080 A 7/1975 Isom
4,022,414 A * 5/1977 Egger ..... 248/150
4,053,028 A 10/1977 Loix
4,119,044 A 10/1978 Hines
4,122,956 A 10/1978 Hargrove
4,144,822 A * 3/1979 Roberts et al. ..... 108/129
4,235,449 A 11/1980 Tarran
4,250,977 A 2/1981 Deli
4,258,827 A 3/1981 Klose
4,632,410 A 12/1986 Bainbridge et al.
4,652,003 A 3/1987 Karashima
4,844,393 A 7/1989 Lee
RE33,645 E * 7/1991 Coote ..... 248/129
5,072,955 A 12/1991 Holland et al.
5,121,890 A * 6/1992 Komada ..... 248/122.1
5,313,892 A 5/1994 Tice
5,540,160 A 7/1996 Rea
5,641,034 A 6/1997 Calmeise et al.
5,803,422 A 9/1998 Buehler
5,882,095 A 3/1999 Green
6,688,634 B2 * 2/2004 Noffsinger ..... 280/651
6,857,378 B2 2/2005 Franz et al.
6,877,442 B2 4/2005 Helle
6,880,835 B2 4/2005 Tornabene et al.
2003/0167980 A1 * 9/2003 Suzuki ..... 108/129
2006/0191448 A1 * 8/2006 Chen et al. ..... 108/125

FOREIGN PATENT DOCUMENTS

EP 1097656 * 3/2000

* cited by examiner

*Primary Examiner*—Janet M. Wilkens
(74) *Attorney, Agent, or Firm*—Steptoe & Johnson LLP

(57) ABSTRACT

A folding table assembly having an open configuration and a closed configuration. Spring loaded hinges provide the folding table assembly with an automated approach to unfolding the table assembly. Casters provide the table assembly with structure making the assembly portable.

18 Claims, 4 Drawing Sheets

FOLDING TABLE ASSEMBLY

BACKGROUND OF THE INVENTION

The present invention relates generally to a table assembly and more particularly, to a portable folding table assembly.

Tables have been used for a multitude of purposes and in many locations and areas. Various tables are permanent structures which provide useable or working surfaces. Tables can be fixtures permanently attached to the floor or to walls or other structure. Other tables are portable but intended to generally remain stationary in a room. Yet other tables are configured to be moved within a room, to and from work areas or areas of use.

Portable tables are particularly useful in work areas such as garages or assembly lines. Such tables can be moved as necessary to assist the operator in his endeavors.

Certain portable tables include adjustable or foldable structures. The tables might be provided with table surfaces that can be risen or lowered or angled as necessary. The tables may also include subassemblies enabling the table to be folded to a compressed state for carrying or storing.

Conventional portable and folding tables while useful, lack the ability to be folded and unfolded with the actuation of a single lever. Portable tables also lack telescoping structure for adjusting the height of a table surface in combination with a plurality of folding subassemblies. Without such structure, converting the folding table between open and collapsed positions requires the use of both hands of the operator as well as unneeded effort, perhaps in situations where the operator is attempting multiple tasks simultaneously such as carrying or holding a tool and providing a work surface adjacent a work area.

Accordingly, what is needed is a folding table which addresses the shortcomings of prior tables and which is portable and convertible between folded and unfolded positions through the use of minimal effort. The present invention satisfies these and other needs.

SUMMARY OF THE INVENTION

Briefly and in general terms, the present invention is directed towards a folding table assembly. The folding table assembly includes an unfolded configuration and a folded configuration. The folding table assembly is also contemplated to include a base with casters or wheels attached thereto, the casters or wheels providing the folding table with structure for transporting the device about a floor surface.

In one aspect, the folding table assembly of the present invention includes a base assembly pivotably attached to a vertical support assembly. The vertical support assembly is in turn pivotably attached to a table platform. The base assembly is foldable with respect to the vertical support assembly independently of the table platform being foldable with respect to the vertical support assembly.

In a particular embodiment of the invention, the folding table includes a first spring-loaded hinge assembly pivotably connecting the base assembly to the vertical support assembly. A second spring-loaded hinge assembly is configured to pivotably connect the vertical support assembly to the table platform. A first lever is associated with the first spring-loaded hinge assembly and a second lever is associated with the second spring-loaded hinge assembly.

In a further aspect, the present invention includes a spring-loaded hinge assembly that accomplishes automatically converting the folding table assembly from a folded position to an unfolded position. At least one spring loaded assembly can also be further configured so that there is also an automatic conversion from an unfolded position to a folded position.

The table assembly of the present invention can include a telescoping vertical support assembly in combination with a plurality of hinge assemblies. The telescoping vertical support assembly includes a locking mechanism to set a height of a table platform and the hinge assemblies provide structures to collapse and open the table. In its collapsed form, the table assembly can be made to have a height defined by the base assembly and a hinge assembly attaching the base to the vertical support. Also, in its collapsed form, the table platform rotates from a position above and parallel to the base to a position displaced laterally and parallel to the base.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENTS

Figure 1:
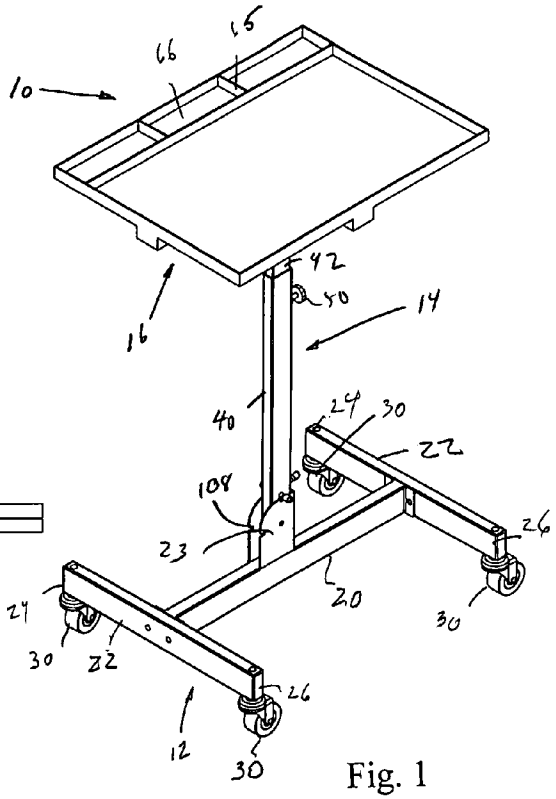
FIG. 1 is a perspective view, depicting a folding table assembly of the present invention.
Figure 2:
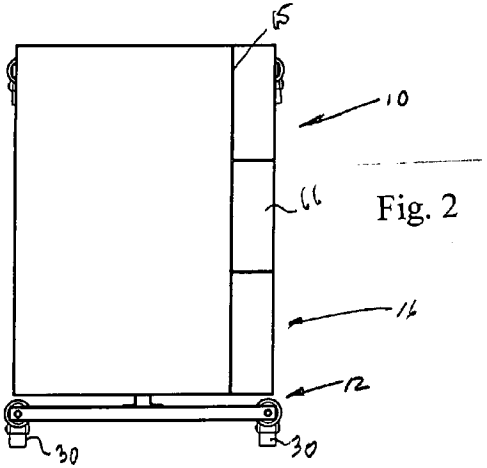
FIG. 2 is a top view, depicting the folding table assembly of FIG. 1.
Figure 4:
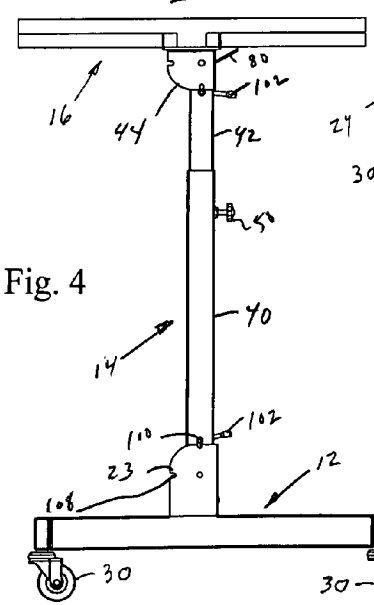
FIG. 4 is an elevation view, depicting a front view of the folding table assembly of FIG. 1.
Figure 3:
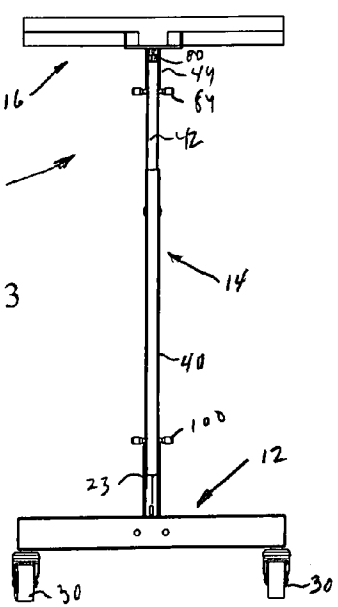
FIG. 3 is an elevation view, depicting an end view of the folding table assembly of FIG. 1.

Referring now to the drawings which are provided by way of example and not limitation, the present invention is embodied in a folding and portable table assembly. In one aspect, the folding table assembly includes spring-loaded hinge assemblies which facilitate the folding and unfolding of the table device.

With reference to FIGS. 1-5, the folding table assembly 10 of the present invention includes a base assembly 12, a vertical support assembly and a table platform assembly 16. The table platform 16 is pivotably connected to the vertical support 14 and the base 12 is pivotably connected to the vertical support 14.

The base 12 includes a cross-member 30 connected at its ends to spaced members 22. A bracket 23 is attached to a mid-point of the cross-member 20 and extends vertically from an upper side of the cross-member 20. The bracket 23 includes a pair of spaced plates sized and shaped to receive a portion of the vertical support 14.

The spaced members 22 are arranged in a parallel manner and each include a pair of terminal ends 24, 26. The cross-member 20 is affixed to the spaced members 22 by conventional means. Also attached to the spaced members 22 at their terminal ends are casters and wheel assemblies 30, such casters and wheel assemblies 30 being affixed at an under side of the base 12. The caster assemblies 30 provide the folding table 10 with structure for transporting the device across a floor surface. Moreover, although shown as having a rectangular cross-section, the cross-member 20 and the spaced members 22 can be made from round stock or other type of members.

The vertical support assembly 14 includes a first member 40 and a second member 42. Such members can also be made from any appropriate tubular or hollow stock. The first member 40 includes a first end pivotably connected to the bracket 23 at a pivot point. The first member additionally includes a second end an interior of which is sized and shaped to receive the second member 42 in a telescoping arrangement.

The second member 42 includes a first end position slidably received within the second end of first member 40. A second end of the second member 40 is pivotably attached to a bracket 44 which includes spaced plates projecting downwardly from a mounting plate 48 (See FIG. 5). The mounting plate 48 is attached to an underside of the table platform 16 by conventional means.

The vertical support assembly further includes structure adapted to lock the first member 40 with respect to the second member 42. In one approach, the first member is provided with an opening through which a set screw 50 is threaded and advanced into and out of contact with the second member 42. In various contemplated embodiments, the second member includes structure that receives the set screw 50 including threaded inserts and through holes. The locking mechanism can also include a biasing structure adapted to retain the locked position of the set screw or other locking structure employed. In this way, the second member 42 can be locked in one or more desired positions to thereby set the table platform assembly 16 at a desired height.

Figure 6:
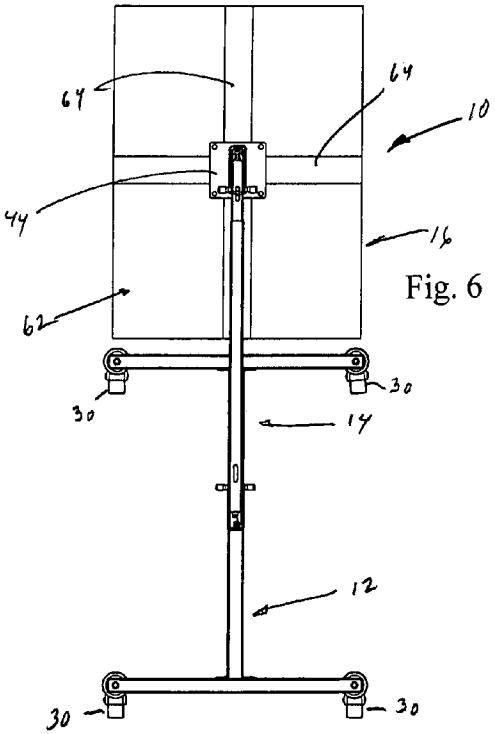
FIG. 6 is a top view, depicting the folding table assembly of FIG. 1 in a folded configuration.
Figure 9:
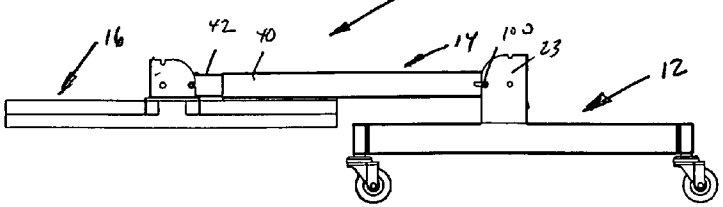
FIG. 9 is an elevation view, depicting a front view of the folding table assembly of FIG. 6.
Figure 8:
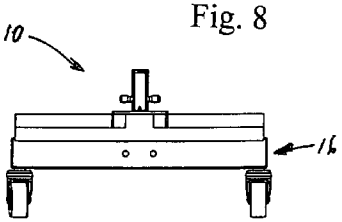
FIG. 8 is an elevation view, depicting an end of the folding table assembly of FIG. 6.

The table platform assembly 16 includes a table surface 60 and an under-surface 62. The under-surface 62 includes a pair of beams 64 arranged to form a cross (See also FIG. 6). The beams 64 form a surface displaced from a planar position of the under-surface 62 against which the mounting plate 48 of the bracket 44 is placed. The mounting plate 48 is affixed to the under-surface 62 by conventional means.

The table surface 60 includes a plurality of low profile walls 65 which define compartments 66 for storing or holding items on the table platform assembly 16. Although shown having four holding compartments 66, the table surface 60 can include any number of various sized and shaped compartments.

Turning now to FIGS. 6-9, the folding table assembly 10 is shown in its fully collapsed or folded configuration. When converting the table assembly from an open configuration to a folded or closed configuration, the vertical support assembly 14 is pivoted with respect to the base assembly 12 and the table platform assembly 16 is pivoted with respect to the vertical support assembly 14. The pivoting of the vertical support assembly 14 with respect to the base assembly 12 can be accomplished independently and before or after the pivoting of the table platform assembly 16 with respect to the vertical support assembly 19. Thus, it is to be understood that the table platform assembly 16 can be placed in a folded position while the vertical support assembly 14 remains in its open or unfolded configuration with respect to the base assembly 12 (not shown).

Figure 5:
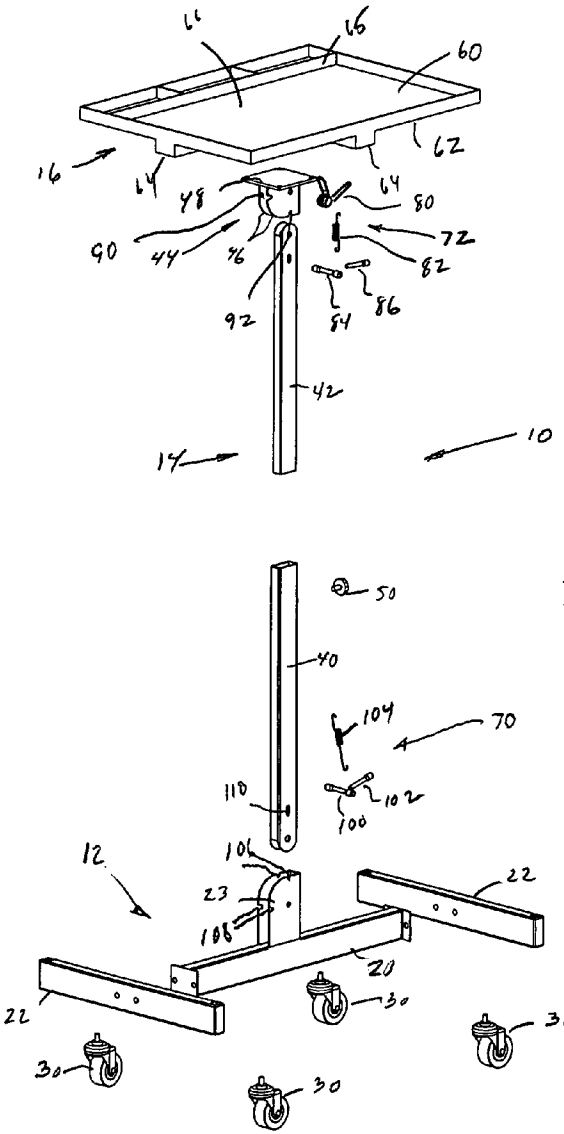
FIG. 5 is an exploded view of the folding table assembly of FIG. 1.
Figure 7:
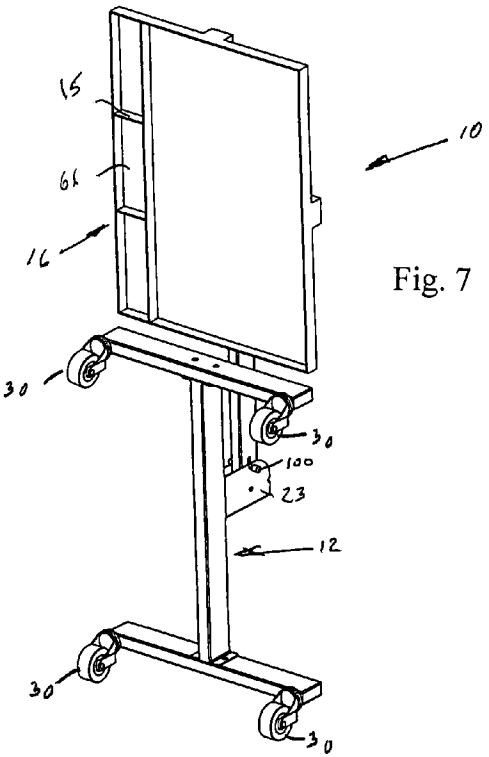
FIG. 7 is a perspective view, depicting the folding table assembly of FIG. 6.
Figure 11:
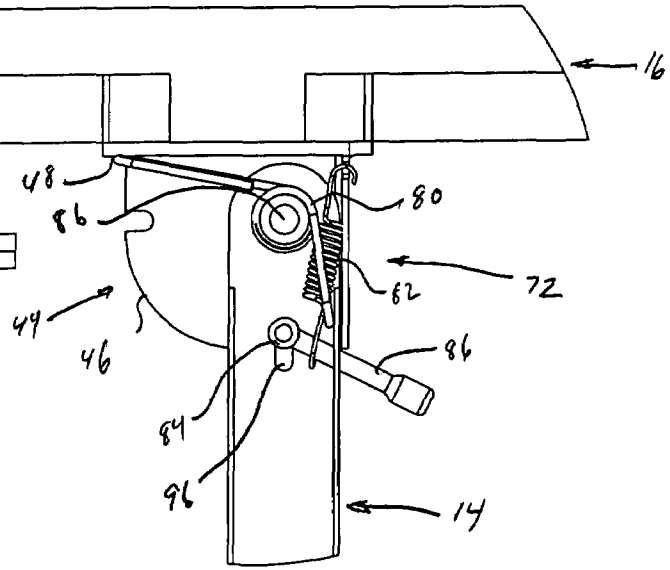
FIG. 11 is an enlarged view, depicting section A of FIG. 10.
Figure 10:
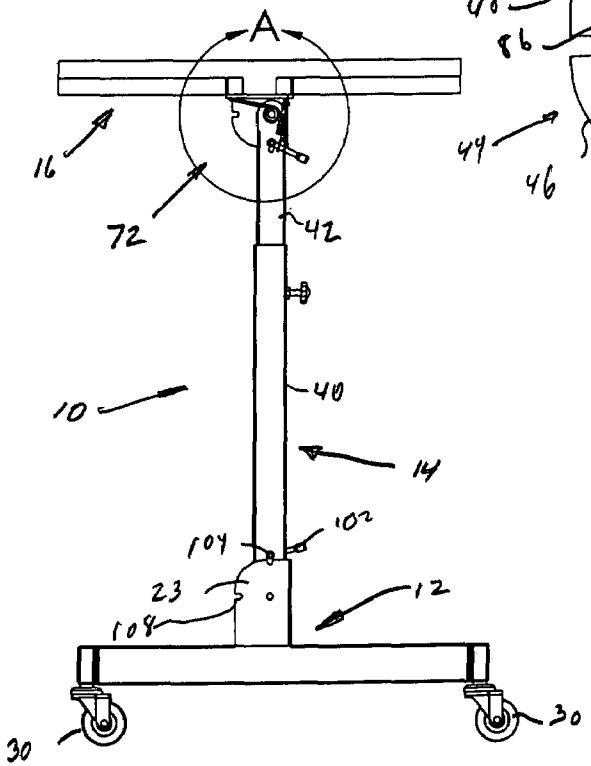
FIG. 10 is a partial cross-sectional view, depicting a front view of the folding table assembly.

With specific reference now to FIGS. 5, 10 and 11, the structure employed to accomplish opening and collapsing the folding table assembly of the table assembly is presented. It is contemplated that the vertical support assembly 14 be automatically or semi-automatically pivoted with respect to both the base assembly 12 and the table platform assembly 16. It is also contemplated that both the acts of folding and unfolding of the vertical support assembly with respect to the base and table platform assemblies 12, 16 be automatic or semi-automatic or that the vertical support assembly 14 is foldable automatically or semi-automatically with respect of the base assembly 12 or table platform assembly 16. To accomplish such folding and opening of the table assembly 10, the assembly is provided with a first spring-loaded hinge assembly 70 and a second spring-loaded hinge assembly 72.

In one preferred embodiment, the second spring-loaded hinge assembly 72 includes a coil spring with wings 80, a compression and tension spring 82, and a pivot rod 84 connected to a lever 86. However, it is to be recognized that the second hinge assembly can also include a second coil spring with wings configured to cooperate with the first coil spring 80 to accomplish both automatic opening and closing of the table platform assembly 16.

The coil spring 80 is configured and attached to the table assembly 10 so as to be biased to an open position. As such, the coil spring 80 tends to cause the table platform assembly 16 to assume an unfolded or open configuration. The coil spring 80 is placed about a pivot point 86 between the vertical support assembly 14 and the table platform assembly 16. As shown in the figures, such a pivot point 86 can be provided by a rod placed through plates 46 of bracket 44 as well as through a receiving hole positioned at the end of the second member 42 of the vertical support assembly 14 which is adjacent the bracket 44. One wing of the coil spring 80 is positioned to apply a force against an underside of the mounting plate 48 and another wing applies a force against an interior surface of the second member 24. In this way, the coil spring 80 which is biased to uncoil, operates to automatically unfold the table platform assembly. A second coil spring with wings which can be configured and biased to close can additionally be added to the assembly adjacent the first coil spring 80 to facilitate automatic closing of the table assembly. In such an arrangement, the relative spring constants of the two springs would need to be selected so that the automatic opening and closing of the table platform assembly 16 an be accomplished once a threshold spring or other force is overcome.

The tension spring 82 and lever 86 and pivot rod 84 of the second spring-loaded hinge assembly 72 cooperates to lock the table platform assembly 16 in both open and closed positions. Depressing lever 86 causes the pivot rod 84 to become dislodged from a pair of parallel slots 90 formed in the bracket 44 so that the coil spring 80 can operate to slowly unfold the table platform assembly 16. This translation of the pivot coil 84 is also permitted by the pair of parallel slots 96 formed in the vertical support assembly 14. Releasing the lever 86 allows the tension spring 82 to bias the pivoting rod 84 back towards a locking engagement. As the table platform 16 pivots to a fully open position the pivot rod 84 engages and becomes locked within a second pair of parallel slots 92 formed in another portion of the bracket 44.

In the event the table assembly 10 includes a second coil spring with wings configured as discussed above, again depressing the lever 86 dislodges the pivot rod 84 from slots 92 and the second coil spring would automatically cause the table platform 16 to assume the closed or folded configuration. Without the second coil spring, the table platform assembly 16 is manually closed.

Like structures can be configured at the pivot juncture between the vertical support assembly 14 and the base assembly 12 (See FIG. 5). That is, one or a pair of coil springs with wings can be employed to automatically open and close the base and vertical support assemblies. Alternatively, the table assembly 10 can omit the coil springs and simply include a pivot arm 100 attached to a lever 102, each being biased to a locked position by a tension spring 104. Slots 106, 108 formed the bracket 23 attached the to base assembly 12 provide two positions in which the pivot rod 100 can be placed. A pair of parallel slots 110 formed in the first member 40 of the vertical support assembly allow the pivoting rod to be moved relative to the vertical support assembly 14.

It is to be recognized that both bracket 44 and bracket 23 can be configured with a series of slots that receive the pivot rods. This series of slots would permit the vertical support assembly 14 to be placed at a plurality of angles with respect to both the base assembly 12 and the table platform assembly 16. In one preferred embodiment, the vertical support assembly 14 pivots in positions which are perpendicular and parallel to the base and table platform assemblies 12, 16.

Thus, it will be apparent from the foregoing that, while particular forms of the invention have been illustrated and described, various modifications can be made without parting from the spirit and scope of the invention.

I claim:

1. A folding table assembly, comprising:

a base assembly;

a vertical support assembly pivotably attached to the base, the vertical support assembly including a first support, a second support and a locking mechanism, the first and second support being arranged telescopically;

a table platform pivotably attached to the vertical support;

a first spring-loaded hinge assembly pivotably connecting the vertical support assembly to the base assembly;

a second spring-loaded hinge assembly pivotably connecting the table platform assembly to the vertical support; and a plurality of casters attached to the base assembly;

wherein the second spring-loaded hinge assembly includes a first stable position and a second stable position and a plurality of transient positions between the first and second stable positions;

wherein the second support is configured to slide with respect to the first support and the locking mechanism operates to lock the second support with respect to the first support;

wherein the second spring-loaded hinge assembly includes a spring which facilitates converting the table platform assembly from a position perpendicular to the vertical support assembly to a position parallel to the vertical support assembly;

wherein the second spring-loaded hinge assembly includes a second spring that facilitates converting the table platform assembly from the position parallel to the vertical support assembly to the position perpendicular to the vertical support assembly.

2. The folding table assembly of claim 1, wherein the table platform assembly is configured to rotate ninety degrees with respect to the vertical support assembly.

3. The folding table assembly of claim 1, wherein the vertical support assembly is configured to rotate ninety degrees with respect to the base assembly.

4. The folding table assembly of claim 1, wherein the first and second spring-loaded hinge assemblies operate independently.

5. The folding table assembly of claim 1, wherein the vertical support assembly includes a fully extended position and a retracted position.

6. The folding table assembly of claim 5, wherein the vertical support assembly is pivotable with respect to the base assembly in the fully extended position and retracted position.

7. The folding table assembly of claim 5, wherein the table platform assembly is pivotable with respect to the vertical support assembly when the vertical support assembly is in the fully extended position and the retracted position.

8. The folding table assembly of claim 5, wherein the locking mechanism can lock the table platform assembly in a plurality of positions between the fully extended position and the retracted position.

9. The folding table assembly of claim 1, wherein the first spring-loaded hinge assembly includes a spring which facilitates converting the vertical support assembly from a vertical position to a horizontal position.

10. The folding table assembly of claim 9, wherein the first spring-loaded hinge assembly includes a lever operatively attached to the spring.

11. The folding table assembly of claim 1, wherein the first and second springs cooperate to convert the table platform assembly between the perpendicular and parallel positions to the vertical support assembly.

12. The folding table assembly of claim 1, wherein the base assembly includes a first bar configured between and perpendicularly to a pair of spaced second bars, each spaced second bar including a pair of terminal ends.

13. The folding table assembly of claim 12, wherein the plurality of casters include four casters.

14. The folding table assembly of claim 13, wherein one caster of the four casters is attached to each of the terminal ends of the spaced bars.

15. The folding table assembly of claim 14, wherein the table platform assembly has a table surface and the folding table assembly converts from a vertical configuration where the table surface faces away from the base to a folded configuration where the table surface is positioned to face the base.

16. The folding table assembly of claim 15, wherein the table platform is arranged above the base when the folding table assembly is in the vertical configuration.

17. The folding table assembly of claim 15, when the table platform is laterally displaced from the base when the folding table assembly is in the folded configuration.

18. A folding table assembly, comprising:

a base assembly;

a vertical support assembly attached to the base;

a table platform pivotably attached to the vertical support;

a first spring-loaded hinge assembly pivotably connecting the vertical support assembly to the base assembly;

a second spring-loaded hinge assembly pivotably connecting the table platform assembly to the vertical support; and wherein the table platform can assume a folded configuration and an unfolded configuration and conversion from the folded to unfolded configuration can be accomplished by a single hand;

wherein the second spring-loaded hinge assembly includes a spring which facilitates converting the table platform assembly from a position perpendicular to the vertical support assembly to a position parallel to the vertical support assembly;

wherein the second spring-loaded hinge assembly includes a second spring that facilitates converting the table platform assembly from the position parallel to the vertical support assembly to the position perpendicular to the vertical support assembly.

* * * * *